United States Patent [19]

Petersen

[11] Patent Number: 4,784,225

[45] Date of Patent: Nov. 15, 1988

[54] WELL VALVE ASSEMBLY METHOD AND APPARATUS

[75] Inventor: William H. Petersen, Kingwood, Tex.

[73] Assignee: Shell Offshore Inc., Houston, Tex.

[21] Appl. No.: 844,430

[22] Filed: Mar. 26, 1986

[51] Int. Cl.[4] ..... E21B 34/06

[52] U.S. Cl. ..... 166/373; 166/186

[58] Field of Search ..... 166/323, 318, 205, 189, 166/186, 19 L, 129, 151, 332, 334, 183, 374, 87

[56] References Cited

U.S. PATENT DOCUMENTS

| | | | |
|---|---|---|---|
| 2,751,017 | 6/1956 | Baker et al. | 166/129 X |
| 2,776,013 | 1/1957 | Tausch | 166/332 X |
| 2,781,854 | 2/1957 | Boer et al. | 166/218 |
| 2,990,883 | 7/1961 | Lewis | 166/120 |
| 2,999,545 | 9/1961 | Bigelow | 166/153 |
| 3,102,594 | 9/1963 | Crowe | 166/125 |
| 3,313,350 | 4/1967 | Page, Jr. | 166/374 |
| 3,378,068 | 4/1968 | Page | 166/1 |
| 3,592,130 | 11/1970 | Stout | 166/318 |
| 3,812,911 | 5/1974 | Vann | 166/19 LX |
| 4,109,716 | 8/1978 | Canalizo | 166/19 LX |
| 4,162,705 | 7/1979 | Daigle | 166/186 |
| 4,248,300 | 2/1981 | Braddick | 166/250 |

*Primary Examiner*—Stephen J. Novosad
*Assistant Examiner*—Matthew Smith
*Attorney, Agent, or Firm*—Paul I. Douglas

[57] ABSTRACT

A well valve assembly is disclosed for the control of well fluids that flow in the tubing and the annulus of a well. The well valve assembly consists of two parts, the first part being a housing that forms a portion of the well that has flow openings defined between the tubing and the annulus. The second portion of the well valve apparatus comprises a valve insert that may be lowered down through the well tubing and latched in a position adjacent the housing means. By proper selection and location of seals and flow passages on the valve insert well fluids in the tubing and the annulus may be controlled in a predetermined manner. Since valve inserts having different configurations may be interchanged within the same housing, the well valve assembly may interchangeably direct the flow of fluids within the well.

11 Claims, 5 Drawing Sheets

19
15
20
34
24
23B
22B
23A
22A
38
25
26
34
17
29
31
38
32
28
27

WELL VALVE ASSEMBLY METHOD AND APPARATUS

FIELD OF THE INVENTION

This invention relates to a well valve assembly used to control the flow of fluids through the annulus and the tubing throughbore of the well. The well valve assembly comprises a housing which forms a portion of the well and a valve insert moveable through the tubing throughbore to a position adjacent the housing.

BACKGROUND OF THE INVENTION

As set forth in U.S. Pat. No. 3,378,068 to J. S. Page, Jr. a well flow control valve is shown which allows annular fluids to pass from the annulus of a well to the tubing throughbore. Such a device utilizes a "sliding sleeve" valve carried by the tubing. The sleeve portion of the valve is actuated from an open or closed position by use of a hydraulically actuated device that is lowered by a wire line downwardly through the tubing throughbore. The valve sleeve contains seals at either end to effectively seal the sliding valve in either the open or the closed position.

Such a sliding sleeve valve is subject to erosion and/or corrosion by the well fluids that pass through its ports with the subsequent requirement of replacement of the seals used by the valve, and/or the replacement of the entire sliding sleeve valve itself. Such a replacement operation requires that the entire tubing string carrying the valve be removed from the well, to allow access to the valve for the required maintenance and repairs. The well must be "shut-in" during this repair, which causes significant loss of revenues in the case of a producing oil or gas well.

A valve need be developed therefore whereby the entire tubing string need not be removed from the well in order to effectively repair and/or replace the valve components subjected to erosion and/or corrosion. In particular the seals on such a valve that isolate one fluid flow zone from another need to be easily replaceable without removal of the entire tubing string.

Such a valve should also be designed so that alternative fluid flow paths may be used between different fluid flow zones of the well, without requiring the retrieval of the entire tubing string in order to change the sliding sleeve valve which has only one set flow path. In other words, the operator of a well should be able to easily change the fluid flow patterns throughout the length of the entire well without the requirement for extensive tubular goods removal and replacement.

SUMMARY OF THE INVENTION

The well valve assembly of the present invention comprises a housing which forms a portion of the well, and a valve insert that is positioned adjacent the housing, such as by being lowered downwardly within the tubing throughbore of the well. The valve insert carries the seals necessary to insure a fluid tight connection between the valve insert and the housing. Since the valve insert is readily retrievable from the well, by for example a wire-line unit or a pipe string, the seals may be easily replaced without removal for example, of the entire tubing string from the well.

The housing typically forms, after installation, a portion of the well's wellhead or tubing string and has openings defined between various fluid flow zones such as between the annulus and the tubing throughbore. By proper formation of the seals and passages through the valve insert, the flow of well fluids may be directed in any desired manner between the fluid flow zones. The flow of fluids may also be terminated from one flow zone to another.

In one preferred application of the device, fluid flow up the annulus and the tubing throughbore is stopped by insertion and subsequent latching of a properly formed valve insert within a housing located in the wellhead, so that the tree may be removed from the wellhead, prior to installation of blowout prevention equipment upon the wellhead.

It is therefore an object of the present invention to control the flow of fluids within a well.

It is a feature of the present invention to provide a well valve assembly for use in controlling the flow of fluids through a well, the well having at least one throughbore defined therethrough and a passage located outward from the throughbore. The well valve assembly comprises; a housing which forms a portion of the well, the housing having flow stops capable of blocking the flow of fluid through the passage and flow openings defined between the passage and the throughbore for placing the passage in fluid communication with the throughbore; and a valve insert moveable through the throughbore to a gauged position within the throughbore adjacent the housing, the valve insert being capable of selectively controlling the flow of fluids through the throughbore and the flow opening means when located in the gauged position.

It is a feature of the present invention to provide a housing and a wire-line retrievable valve insert locatable within the housing. The valve insert may be lowered and latched in a gauged position within a previously installed housing and is capable of controlling the flow of well fluids through flow opening(s) formed between the tubing throughbore of the well and an annular passage formed radially outward from the tubing throughbore.

These and other features, objects and advantages of the present invention will become apparent from the following detailed description, wherein reference is made to the figures in the accompanying drawings.

IN THE DRAWINGS

DESCRIPTION OF THE PREFERRED EMBODIMENT

Figures 1, 2:
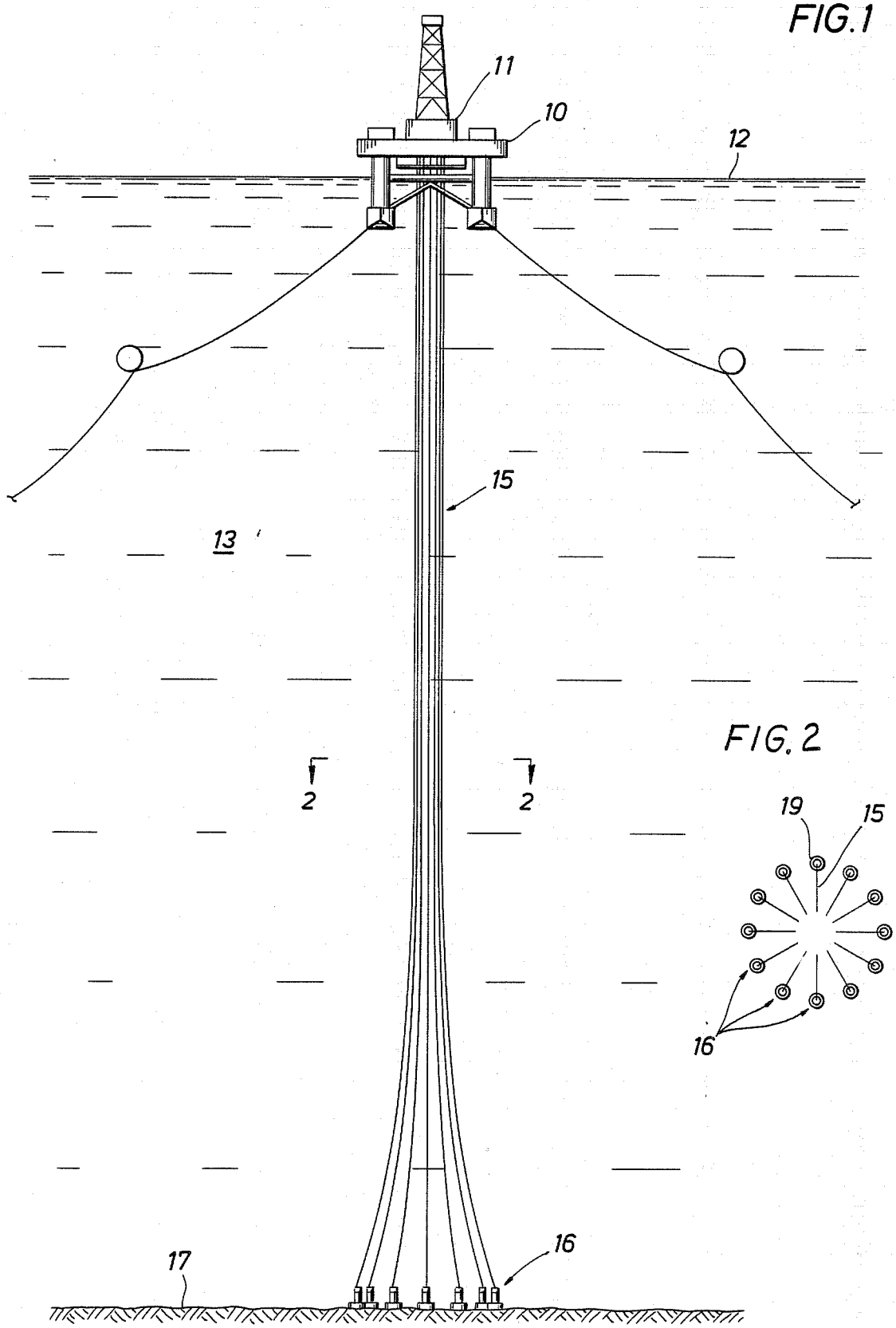
FIG. 1 is a schematic representation showing a floating platform having marine risers depending downwardly to subsea well equipment.
FIG. 2 is a schematic representation taking along lines 2—2 of FIG. 1 showing in plan view the orientation of the subsea wellhead equipment.

Referring now to FIG. 1 a floating platform 10 carrying well drilling and/or production equipment 11 is shown floating on a surface 12 of a body of water 13. Marine risers 15 depend downwardly from the platform 10 and are connected at the lower end to subsea well equipment 16 located upon the seafloor 17.

Referring now to FIG. 2 the subsea well equipment 16 can be seen to comprise an array of subsea wells 19 placed in fluid communication with the marine risers 15.

Figure 3:
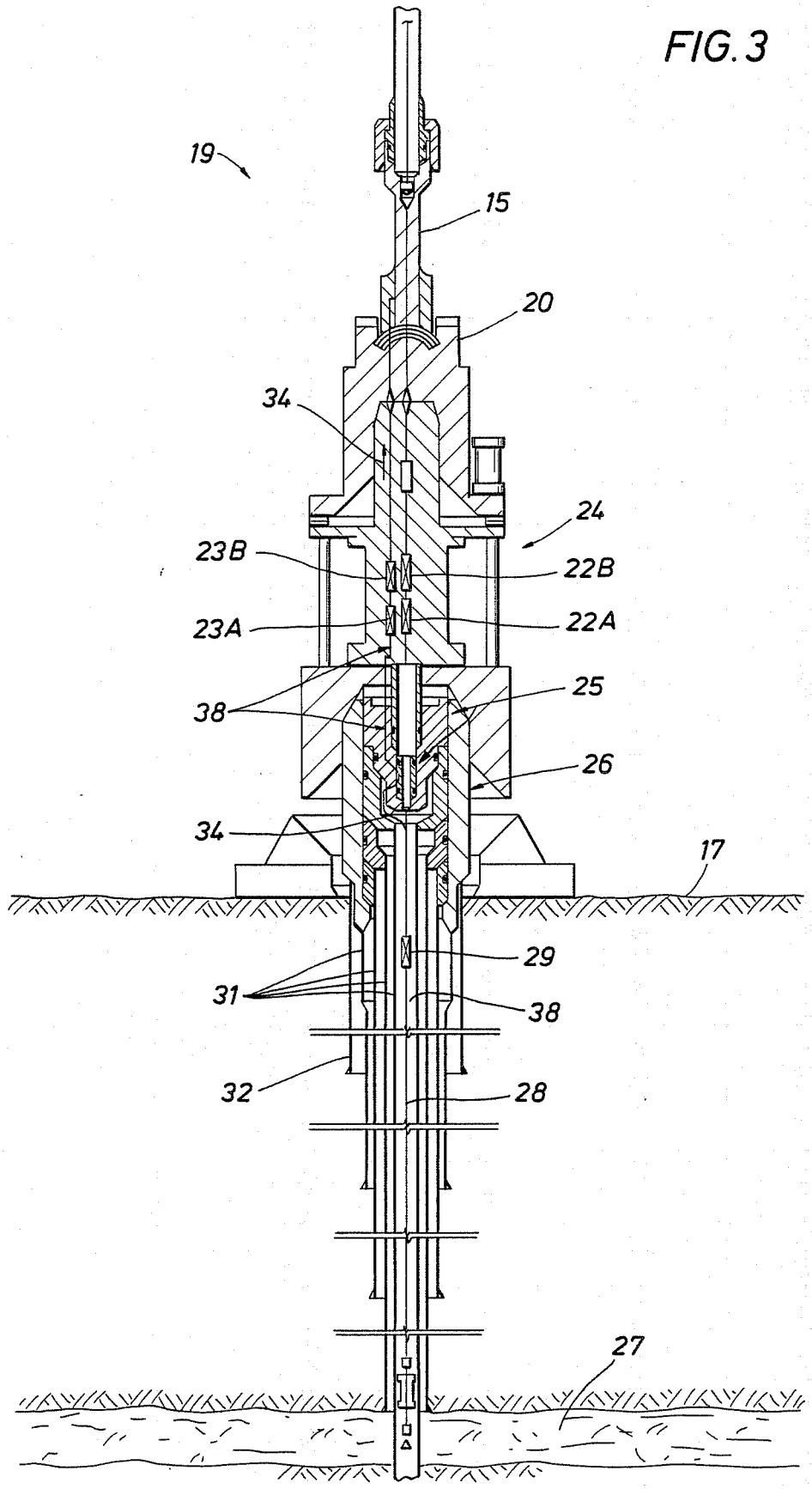
FIG. 3 is a schematic representation showing in more detail the components forming the subsea well and the location of a well valve assembly within the wellhead of the subsea well.

Referring now to FIG. 3 the subsea well 19 carried by the seafloor 17 is shown in more detail. The marine riser 15 is shown connected at its lower end through flexible joint 20 to well tree 24 having tubing valves 22A, 22B, respectively, and also annulus valves 23A and 23B, respectively.

The well valve assembly 25, the object of the present invention, is shown in a preferred embodiment located within the tree 24 within wellhead 26. It shall be well recognized however that the well valve assembly 25 may also be located within the tubulars connected to or which form any portion of a well, such as adjacent producing formations 27, within well drilling and/or production equipment 11, (FIG. 1), or within marine risers 15. In other words, the assembly 25 may be positioned at any location within a well and its associated connected piping.

The well 19 will typically include tubing 28, a subsurface safety valve 29 well known to the art, and casing 31 having various diameters shown located within conductor 32, as is well known to the art. In a preferred embodiment the flow of annulus fluid indicated by arrow 34, passes upwardly through an annular passage 38 defined radially outward from tubing 28, thereafter through the well valve assembly 25, and thereafter through annulus valves 23A, 23B located in tree 24.

Well fluid also passes through the tubing 28, and the well valve assembly 25. The valve assembly 25 therefore may control the flow of annulus fluid through the annular passage 38, and may also control the flow of well fluids through the tubing 28.

For example, if it is desired to remove the tree 24 from the wellhead 26 annulus valves 23A, 23B and tubing valves 22A, 22B will no longer be available to isolate or control the flow of well fluids from the well 19. The well valve assembly 25, however, may be used to shut off flow from the well 19.

Figure 4:
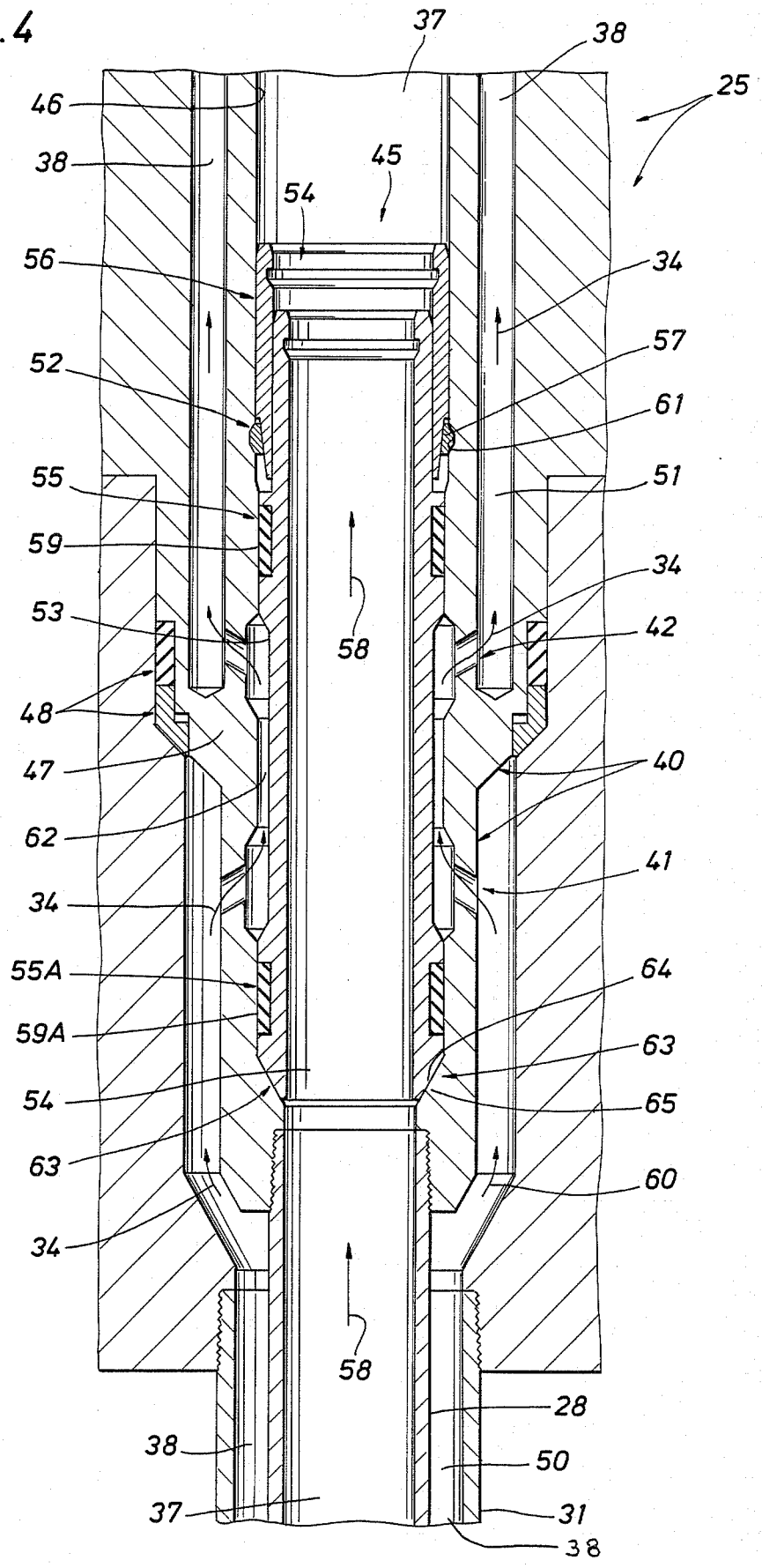
FIG. 4 is a schematic representation of the well valve assembly comprising a housing and a valve insert, the valve insert allowing well fluids to pass through the annular passage and the tubing throughbore.

Referring now to FIG. 4 the well valve assembly 25 is shown in more detail. The valve assembly 25 is shown installed within the well which has a tubing throughbore 37 defined therethrough and an annular passage 38 located outward from the throughbore 37 as is well known to the art. A portion of the well valve assembly 25 can be seen to be comprised of housing means 40 which form a portion of the well. The housing means 40 have flow stop means 47 formed from a radially outwardly-extending shoulder having seal means 48 such as O-rings or molded packing well known to the art. The flow stop means 47 effectively block the flow of well fluids through the annular passage 38, and effectively divide the passage 38 into a first annulus 50 and a second annulus 51. The housing means 40 also include flow opening means such as first flow opening means 41, which form at least one opening defined between the first annulus 50 and the throughbore 37 for placing the first annulus 50 in fluid communication with the throughbore 37. The flow opening means also include second flow opening means 42 which form at least one opening defined between the throughbore 37 and the second annulus 51 for placing the throughbore 37 in fluid communication with the second annulus 51. It should be well recognized that different designs of opening means 41, 42 may be used to effectively place the first and second annulus 50, 51 in fluid communication with a portion of the tubing throughbore 37. The housing means 40 also have an inner surface 46 formed common with the tubing throughbore 37.

The housing means 40 also include a first portion of latch means 52 operatively formed in a preferred embodiment by latch recess 61, an annular groove formed about the housing means 40 inner surface 46, as is well known to the art. The latch means 52 have a second portion operatively formed and carried by the upper end of valve insert means 45. It shall be well recognized that latch means 52, 52A, 52B shown in FIGS. 4, 5, and 6 may take any other form well known to the art other than the latch recess 61 and latch 57 mechanism shown in FIGS. 4, 5, and 6.

Figure 5:
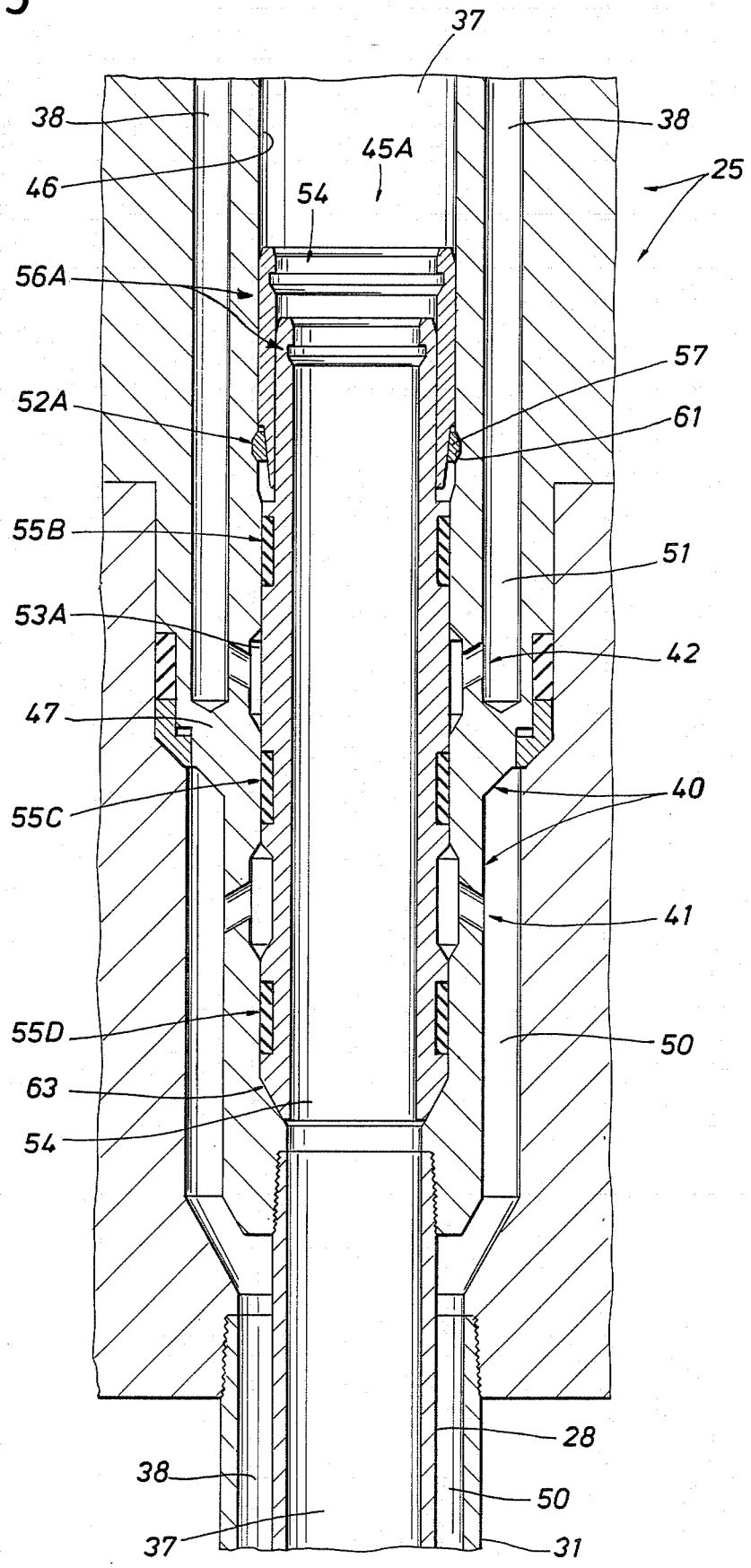
FIG. 5 is a schematic diagram of the well valve assembly, wherein the valve insert prevents the flow of well fluids through the annular passage, yet permits well fluids to flow through the tubing throughbore.
Figure 6:
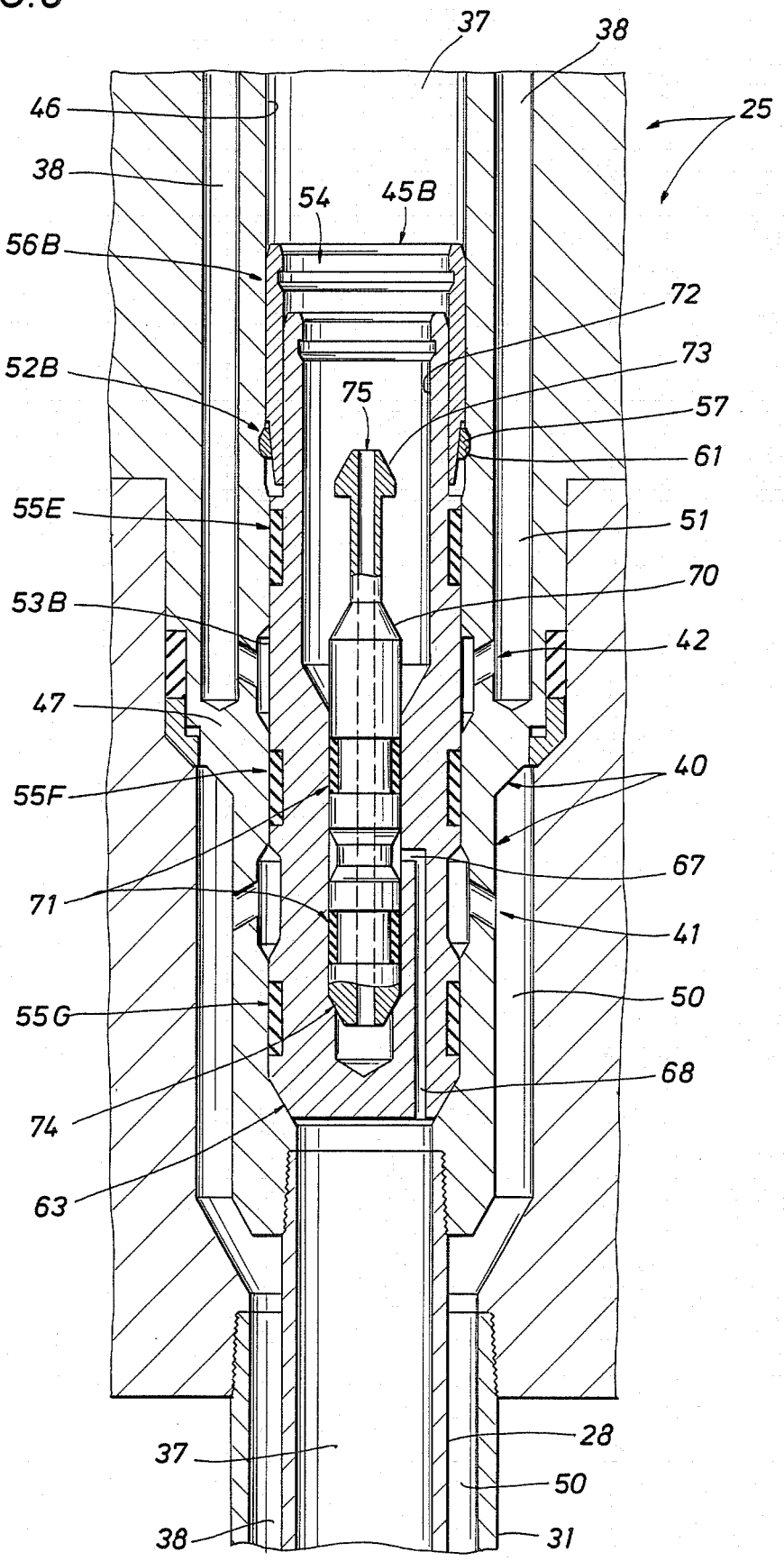
FIG. 6 is a schematic representation of the well valve assembly, wherein the valve insert prevents the flow of well fluids through the annular passage and the tubing throughbore.

It should be well recognized that the valve insert means 45, 45A, 45B shown in FIGS. 4, 5, and 6 need only be locatable at a gauged position within housing means 40, and may be held for example in position by threaded engagement between valve insert means 45, 45A, 45B and housing means 40 instead of by being latched in position.

The other portion of the well valve assembly 25 includes valve insert means 45 which are moveable through the throughbore 37. The insert means 45 may be located within said throughbore 37 in a gauged position, as shown in FIG. 4, adjacent the housing means 40.

The valve insert means 45 in a preferred embodiment further include a tubular body 53 having a central opening 54, seal means 55, 55A such as "O"-rings or molded packing well known to the art, and retrieval means 56 such as a recessed shoulder formed to cooperate with a retrieval device lowerable downwardly through the throughbore 37 by a wire line unit (not shown for purposes of clarity), or at the lower end of a pipe string (not shown). The tubular body 53 may therefore be raised and lowered through the tubing throughbore 37 by use of the retrieval means 56.

The central opening 54 is defined centrally through the tubular body 53 and is placed in fluid communication with the tubing throughbore 37, to allow well fluids indicated by arrow(s) 58, in the throughbore 37 to pass upward or downward through the tubular body 53. The seal means 55, 55A have sealing surfaces 59 formed around the outer surface of the tubular body 53, the seal means 55, 55A being slideably engaged in a fluid-tight manner with the inner surface 46 of the housing means 40. As shown in FIG. 4, the seal means 55A, 55 are positioned below and above the first flow opening means 41 and the second flow opening means 42 respectively when the tubular body 53 is latched in the gauged position.

As mentioned earlier the valve insert means 45, 45A, 45B in a preferred embodiment have or carry latch 57, the second portion of the latch means 52, 52A, 52B. Latch 57 by cooperative engagement with latch recess 61 effectively latches the valve insert means 45, 45A, 45B in a gauged position relative to the housing means 40.

A third annulus 62 is defined between the seal means 55, 55A and between adjacent portions of the housing means 40 and the tubular body 53 when the tubular body 53 is located in the gauged position. The third annulus 62 can be seen to place the first flow opening means 41 in fluid communication with the second flow opening means 42 in order to allow well fluids indicated by arrow 34 to flow from the first annulus 50 to the second annulus 51. The valve insert means 45 therefore allows well fluids in the annular passage 38 and the tubing throughbore 37 to pass through the well valve assembly 25 without mixing.

In order to insure the proper gauged positioning of the valve insert means 45 relative to the housing means 40, the housing means 40 and the valve insert means 45 include portions of tubular body shoulder means 63 formed from cooperating inwardly sloping shoulders, 64 and 65, as is well known to the art.

Referring now to FIG. 5 a principal advantage of the present invention becomes readily apparent. Valve insert means 45A, having a different sealing arrangement than valve insert means 45 as shown in FIG. 4, may be used to terminate the flow of well fluids up through annular passage 38 while still allowing the flow of well fluids through tubing throughbore 37. Note that the entire tubing string with the incorporated housing means 40 did not need to be retrieved to the surface to change from the well fluid flow pattern shown in FIG. 4. In other words, the flow patterns through the well valve assembly 25 may be modified by retrieval only of the valve insert means 45, 45A portion of the valve assembly 25, not also the entire housing means 40. To accomplish this same mechanical result by use of the apparatus disclosed in the '068 patent issued to John S. Page, Jr., the entire tubing string would have to be retrieved from the well, involving considerable down time and loss of production.

Referring now more specifically to FIG. 5, the valve insert means 45A can be seen to further include a tubular body 53A having a central opening 54, seal means 55B, 55C and 55D, and retrieval latch means 56A. The seal means 55B through D can be seen to have sealing surfaces formed around the outer surface of the tubular body 53A. The seal means 55B through D as before are slideably engaged in a fluid-tight manner with the inner surface 46 of the housing means 40. Seal means 55D is positioned below the first flow opening means 41, seal means 55C is positioned between the first flow opening means 41 and the second flow opening means 42, and seal means 55B is positioned above the second flow opening means 42. In this manner, the seal means 55B through D prevent the flow of fluids between the first annulus 50 and the second annulus 51. As before the tubular body shoulder means 63 insure that the tubular body 53A is properly placed in a gauged position relative to the housing means 40. Retrieval means 56A may be used to raise and lower the tubular body 53A through the tubing throughbore 37. Latch means 52A latch the valve insert means 45A in a gauged position relative to the housing means 40.

Referring now to FIG. 6, a valve insert means 45B of the well valve assembly 25 in combination with the housing means 40 may be used to block the flow of fluid through both the annular passage 38 and the tubing throughbore 37. Seal means 55E, 55F and 55G may be positioned relative to the first flow opening means 41 and second flow opening means 42 to block the flow of fluid through the annular passage 38 and thereby isolate the first annulus 50 from the second annulus 51. Retrieval means 56B formed at the upper end of the tubular body 53B may be used to raise or lower the valve insert means 45B through the tubing throughbore 37. Tubular body shoulder means 63 as before may be used to place the tubular body 53B in a gauged position relative to the housing means 40. Latch means 52B latch the valve insert means 45B in a gauged position relative to the housing means 40, and prevent upward movement of the valve insert means 45B due to higher pressure well fluids located beneath valve insert means 45B.

To terminate the flow of fluid through the tubing throughbore 37 the tubular body 53B in a preferred embodiment now includes a vent port opening 67, which is placed in fluid communication with the central opening 54, and which thereafter extends radially outward from the central opening 54 through a portion of the tubular body 53B. An equalizer passage 68 thereafter extends downward from the vent port opening 67 through the tubular body 53B and into fluid communication with the portion of the tubing throughbore 37 located below the tubular body 53B. It is well recognized that many other orientations of port opening 67 and equalizer passage 68 may be used to accomplish the same mechanical result.

The valve insert means 45B also includes a central plug 70 formed to be lowered downward within the central opening 54 to a gauged position within the tubular body 53B. The central plug has central plug seal means 71 which have sealing surfaces formed around the outer surface of the plug 70 that are slideably engaged in a fluid-tight manner with the inner surface 72 of the tubular body 53B, the seal means 71 being positioned below and above the vent port openings 67 when the central plug 70 is located in the gauged position within the tubular body 53B to prevent well fluid flow through the tubular body 53B. The central plug 70 also includes retrieval bullnose means 73 formed at the upper end of the central plug 70 by which the central plug 70 may be raised and lowered through the tubing throughbore 37 and the central opening 54. The central plug 70 and the tubular body 53B further include portions of central plug shoulder means 74 formed from cooperating inwardly sloping shoulders, the shoulder means 74 located to position the central plug 70 in a gauged position relative to the tubular body 53B. The central plug 70 also has an equalizer opening 75 in a preferred embodiment defined centrally therethrough in order to place the well fluids located beneath the central plug seal means 71 in fluid communication with the well fluids located above the central plug seal means 71. In this manner well fluids are not trapped beneath the plug 70 prior to the plug 70 contacting the shoulder means 74.

The tubular body 53B may be positioned adjacent the housing means 40 and thereafter the central plug 70 may be lowered downwardly through the tubing throughbore 37 to a gauged position within the tubular body 53B.

In operation, a method of selectively controlling the flow of fluids through a well 19 having a tubing throughbore 37 and an annular passage 38 would comprise the following steps.

Housing means 40 capable of being installed within the well 19 would be provided. The housing means 40 would have flow stop means 47 capable of blocking the flow of fluid through the passage 38, the flow stop means 47 dividing the passage 38 into a first annulus 50 and a second annulus 51. The housing means 40 would also have flow opening means having first flow opening means 41 and second flow opening means 42, and a first portion of latch means 52, for the purposes mentioned earlier.

Valve insert means 45, 45A, 45B would be provided, having the desired combination of seal means 55-55A-G, third annulus 62 (as shown in FIG. 4), and/or central plug 70 with central plug seal means 71, in order to selectively control the flow of fluids through the throughbore 37 and the annular passage 38. Valve insert means 45, 45A, 45B would also have the second portion of latch means 52, for the purposes mentioned earlier.

The housing means 40 would then be installed within the well preferably during the assembly of the well.

The valve insert means, 45, 45A, or 45B, would then be positioned, in a preferred embodiment by latching, in the gauged position adjacent the housing means 40 to control the flow of fluids through the throughbore 37 and the annular passage 38.

The valve insert means 45, 45A, or 45B may be located in the gauged position by lowering the insert means 45, 45A, or 45B downwardly through the throughbore 37 by means of a wire-line (or pipe string). Alternatively, the valve insert means 45, 45A, or 45B may be installed in the gauged position during the installation of the housing means 40 in the well 19.

Once production is commenced the valve insert means 45, 45A, 45B may be readily interchanged within the housing means 40 by use of a wire-line unit. The flow of fluids through the well 19 may therefore be easily altered by removal of one insert means 45, 45A, 45B and insertion of one having a different seal 55 and/or annulus 62 arrangement.

Of course, it should be well recognized that other flow patterns may be established in a well by other valve inserts 45 than those as set forth in FIGS. 4, 5, and 6.

Many other variations and modifications may be made in the apparatus and techniques hereinbefore described, by those having experience in this technology, without departing from the concept of the present invention. Accordingly, it should be clearly understood that the apparatus and methods depicted in the accompanying drawings and referred to in the foregoing description are illustrative only and are not intended as limitations on the scope of the invention.

I claim as my invention:

1. A well valve assembly for use in controlling the flow of fluids through a passage defined through a well, said well having at least one throughbore defined therethrough, said passage being located outward from said throughbore, said well valve assembly comprising:

housing means having said throughbore defined therethrough, said housing means forming a portion of the well tree of said well, said housing means having:

flow stop means capable of blocking the flow of fluid through said passage, said flow stop means dividing in a fluid-tight manner said passage into a first annulus and a second annulus; and flow opening means having first flow opening means defining at least one opening between said first annulus and said throughbore and having second flow opening means defining at least one opening between said throughbore and said second annulus, for placing said first annulus in fluid communication with said throughbore, and placing said throughbore in fluid communication with said second annulus; and a first portion of latch means operatively formed by said housing means; and valve-insert means capable of being lowered into the housing means after said housing means form a portion of said well tree, said valve insert means having a second portion of said latch means operatively formed thereto, said valve insert means being latched by cooperative engagement of said first portion and said second portion of said latch means operatively formed thereto, said valve insert means being latched by cooperative engagement of said first portion and said second portion of said latch means at a gauged position within said throughbore adjacent said housing means after having been lowered within said housing means, said valve insert means being movable through at least a portion of said throughbore defined through and above said housing means and being capable of selectively controlling the flow of fluids through said passage when latched in said gauged position.

2. A well valve assembly for use in controlling the flow of well fluids through an annular passage defined through a well, said well having a tubing throughbore defined therethrough, said annular passage being located radially outward from said tubing throughbore, said well valve assembly comprising:

housing means having said throughbore defined therethrough, said housing means forming a portion of the well tree of said well, said housing means having:

an inner surface formed common with said tubing throughbore, flow stop means capable of blocking the flow of well fluids through said annular passage, said flow stop means dividing in a fluid-tight manner said annular passage into a first annulus and a second annulus, first flow opening means forming at least one opening defined between said first annulus and said tubing throughbore for placing said first annulus in fluid communication with said tubing throughbore, second flow opening means forming at least one opening defined between said tubing throughbore and said second annulus for placing said tubing throughbore in fluid communication with said second annulus, and a first portion of latch means operatively formed by said housing means; and valve insert means capable of being lowered into the housing means after said housing means form a portion of said well tree, said valve insert means having a second portion of said latch means operatively formed thereto, said valve insert means being latched by cooperative engagement of said first portion and said second portion of said latch means at a gauged position within said tubing throughbore adjacent said housing means, said valve insert means being movable through at least a portion of said throughbore defined through and above said housing means and being capable of selectively controlling the flow of fluids through said annular passage when latched in said gauged position.

3. The apparatus of claim 2, wherein said valve insert means further includes;

a tubular body having a central opening defined centrally therethrough in fluid communication with said tubing throughbore, to allow well fluids in said tubing throughbore to pass through said tubular body, seal means having sealing surfaces formed around the outer surface of said tubular body, said seal means being slideably engaged in a fluid-tight manner with said inner surface of said housing means, said seal means being positioned below and above said first flow opening means and said second flow opening means respectively when said tubular body is latched in said gauged position, retrieval means formed at the upper end of said tubular body by which said tubular body may be raised and lowered through said tubing throughbore, and a latch which forms said second portion of said latch means, operatively carried adjacent the outer surface of said tubular body and being engaged with a cooperating latch recess formed about the inner surface of the housing means, said latch recess forming the first portion of said latch means, and wherein a third annulus located between said seal means is defined between adjacent portions of said housing means and said tubular body when said tubular body is latched in said gauged position, said third annulus placing said first flow opening means in fluid communication with said second flow opening means to allow well fluids to flow from said first annulus to said second annulus.

4. The apparatus of claim 2 wherein said valve insert means further includes;

a tubular body having a central opening defined centrally therethrough in fluid communication with said tubing throughbore, to allow well fluids in said tubing throughbore to pass through said tubular body, seal means having sealing surfaces formed around the outer surface of said tubular body, said seal means being slideably engaged in a fluid-tight manner with said inner surface of said housing means, said seal means being positioned below said first flow opening means, between said first flow opening means and said second flow opening means, and above said second flow opening means when said tubular body is latched in said gauged position, said seal means positioned between said first flow opening means and said second flow opening means to prevent the flow of fluids between said first annulus and said second annulus, retrieval means formed at the upper end of said tubular body by which said tubular body may be raised and lowered through said tubing throughbore, and a latch which forms said second portion of said latch means, operatively carried adjacent the outer surface of said tubular body and being engaged with a cooperating latch recess formed about the inner surface of the housing means, said latch recess forming the first portion of said latch means.

5. A well valve assembly adapted to control the flow of fluids through a passage defined through said well, said well having at least one throughbore defined therethrough, said passage being located outward from said throughbore, said well valve assembly comprising:

housing means having said throughbore defined therethrough, said housing means capable of forming a portion of the well tree of said well, said housing means having:

flow stop means capable of blocking the flow of fluid through said passage, said flow stop means capable of dividing in a fluid-tight manner said passage into a first annulus and a second annulus; and flow opening means having first flow opening means capable of defining at least one opening between said first annulus and said throughbore and having second flow opening means capable of defining at least one opening between said throughbore and said second annulus, for placing said first annulus in fluid communication with said throughbore, and placing said throughbore in fluid communication with said second annulus; and a first portion of latch means operatively formed by said housing means; and valve insert means capable of being lowered into the housing means after said housing means form a portion of the well tree, said valve insert means having a second portion of latch means operatively formed thereto, said valve insert means capable of being latched by cooperative engagement of said first portion and said second portion of said latch means at a gauged position adjacent said housing means, said valve insert means capable of movement through at least a portion of said throughbore defined through and above said housing means and being capable of selectively controlling the flow of fluids through said passage when latched in said gauged position.

6. A method of selectively controlling the flow of fluids through a passage defined through a well, said well having a throughbore, said passage being located radially outward from said throughbore, said method comprising:

providing housing means having said throughbore defined therethrough capable of installation within the well tree of said well, said housing means having;

flow stop means capable of blocking the flow of fluid through said passage, said flow stop means dividing in a fluid-tight manner said passage into a first annulus and a second annulus;

flow opening means having first flow opening means defining at least one opening between said first annulus and said throughbore and having second flow opening means defining at least one opening between said throughbore and said second annulus, for placing said first annulus in fluid communication with said throughbore, and placing said throughbore in fluid communication with said second annulus; and a first portion of latch means operatively formed by said housing means; and providing valve insert means, said valve insert means capable of being lowered into the housing means after said housing means form a portion of said well tree, said valve insert means having a second portion of said latch means operatively formed thereto, said valve insert means being latched by cooperative engagement of said first portion and said second portion of said latch means at a gauged position within said throughbore adjacent said housing means, said valve insert means being capable of movement through said throughbore and said flow opening means, when latched in said gauged position, installing during the assembly of said well, said housing means within a portion of said well tree of said well, lowering said valve insert means towards said housing means, locating said valve insert means in said gauged position adjacent said housing means, and thereby controlling the flow of fluids through said passage.

7. The method of claim 6 wherein the step of locating said valve insert means in said gauged position adjacent said housing means further includes the step of;

lowering said valve insert means downwardly through said throughbore to said gauged position.

8. The method of claim 6 wherein the step of locating said valve insert means in said gauged position adjacent said housing means further includes the steps of;

latching said valve insert means in said gauged position adjacent said housing means.

9. A well valve assembly for use in controlling the flow of fluids through a well passage, said well having at least one throughbore defined therethrough, said passage being located outward from said throughbore, said well valve assembly comprising:

housing means having said throughbore defined therethrough, said housing means forming a portion of the well tree of said well, said housing means capable of blocking the flow of fluid through said passage and dividing said passage into a first annulus and a second annulus; said housing means having flow openings capable of placing said first annulus in fluid communication with said throughbore, and placing said throughbore in fluid communication with said second annulus; and valve insert means capable of being lowered into the housing means after said housing means form a portion of said well tree, said valve insert means locatable at a gauged position within said throughbore adjacent said housing means, said valve insert means being moveable through at least a portion of said throughbore above said housing means and being capable of selectively controlling the flow of fluids through said passage when latched in said gauged position.

10. A well valve assembly for use in controlling the flow of well fluids through an annular passage defined through a well, said well having a tubing throughbore defined therethrough, said annular passage being located radially outward from said tubing throughbore, said well valve assembly comprising:

housing means having said throughbore defined therethrough, said housing means forming a portion of said well tree, said housing means having:

an inner surface formed common with said tubing throughbore, flow stop means capable of blocking the flow of well fluids through said annular passage, said flow stop means dividing in a fluid-tight manner said annular passage into a first annulus and a second annulus, first flow opening means forming at least one opening defined between said first annulus and said tubing throughbore for placing said first annulus in fluid communication with said tubing throughbore, second flow opening means forming at least one opening defined between said tubing throughbore and said second annulus for placing said tubing throughbore in fluid communication with said second annulus, and a first portion of latch means operatively formed by said housing means; and valve insert means moveable relative to said housing means having a second portion of said latch means operatively formed thereto, said valve insert means being latched by cooperative engagement of said first portion and said second portion of said latch means at a gauged position within said tubing throughbore adjacent said housing means, said valve insert means being moveable through at least a portion of said throughbore defined through said housing means and being capable of selectively controlling the flow of fluids through said annular passage when latched in said gauged position; and wherein said valve insert means further includes:

a tubular body having a central opening defined centrally downward through a portion of said tubular body, in fluid communication with the portion of said tubing throughbore located above said tubular body, an inner surface formed common with said central opening, a vent port opening placed in fluid communication with said central opening, extending from said central opening through a portion of said tubular body, an equalizer passage extending from said vent port opening through said tubular body and into fluid communication with the portion of said tubing throughbore located below said tubular body, seal means having sealing surfaces formed around the outer surface of said tubular body, said seal means being slideably engaged in a fluid-tight manner with said inner surface of said housing means, said seal means being positioned below said first flow opening means and said second flow opening means, and above said second flow opening means when said tubular body is latched in said gauged position, one of said seal means positioned between said first flow opening means and said second flow opening means to prevent the flow of fluid between said first annulus and said second annulus, retrieval means formed at the upper end of said tubular body by which said tubular body may be raised and lowered through said tubing throughbore, a latch which forms said second portion of said latch means, operatively carried adjacent the outer surface of said tubular body and being engaged with a cooperating latch recess formed about the inner surface of the housing means, said latch recess forming the first portion of said latch means, a central plug having an equalizer opening defined therethrough, said central plug formed to be placed within said central opening of said tubular body and located at a gauged position within said tubular body, central plug seal means having sealing surfaces formed around the outer surface of said central plug, said central plug seal means being slideably engaged in a fluid-tight manner with said inner surface of said tubular body, said seal means being positioned below and above said vent port openings, when said central plug is located in said gauged position within said tubular body, to prevent well fluid flow through said tubular body, said equalizer opening placing the well fluids located below said central plug seal means in fluid communication with the well fluids located above said central plug seal means; and retrieval bullnose means formed at the upper end of said central plug by which said central plug may be raised and lowered through said tubing throughbore and said central opening.

11. The apparatus of claim 10 wherein said central plug and said tubular body further include portions of central plug shoulder means fomred from cooperating inwardly sloping shoulders, said shoulder means located to position said central plug at said gauged position relative to said tubular body.

* * * * *